United States Patent [19]

Albertine, Jr. et al.

[11] 4,051,408

[45] Sept. 27, 1977

[54] CIRCULAR PLASMA CHARGE DISPLAY DEVICE

[75] Inventors: Herman Albertine, Jr., Geneva; Donald G. Craycraft; William E. Coleman, both of St. Charles, all of Ill.

[73] Assignee: NCR Corporation, Dayton, Ohio

[21] Appl. No.: 648,766

[22] Filed: Jan. 13, 1976

[51] Int. Cl.[2] ..... H05B 41/14; H05B 41/44

[52] U.S. Cl. ..... 315/169 R; 315/84.6; 340/173 PL; 340/324 R

[58] Field of Search ..... 315/169 R, 169 TV, 84.6; 340/324 R, 173 PL

[56] References Cited

U.S. PATENT DOCUMENTS

| | | | |
|---|---|---|---|
| 3,456,152 | 7/1969 | Andersen | 315/84.6 |
| 3,500,121 | 3/1970 | Dekoster et al. | 315/84.6 |
| 3,781,600 | 12/1973 | Coleman et al. | 315/169 TV |

*Primary Examiner*—Eugene R. LaRoche
*Attorney, Agent, or Firm*—Lowell C. Bergstedt

[57] ABSTRACT

A plasma charge display device having a channel containing an ionizable medium with the channel defining an endless length as in the case of a circular channel. At least one input electrode is located in a first position, and transfer electrodes extend away from the input electrode on opposite sides thereof completely along the length of the channel. Gas ionization results in the formation and shifting of light emitting areas in either direction relative to the position of the input electrode. The transfer electrode positions are related to the input electrode position in a manner such that the light emitting areas can be shifted through the position of the input electrode from one side to the other thereof.

11 Claims, 9 Drawing Figures

FIG. 1
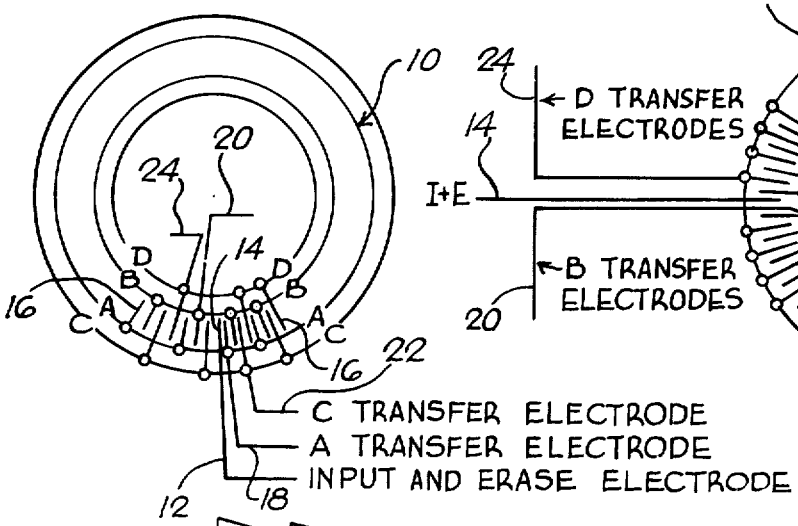
FIG. 2
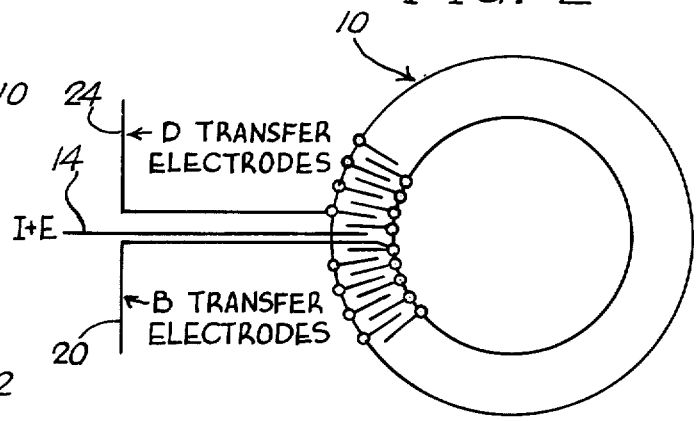
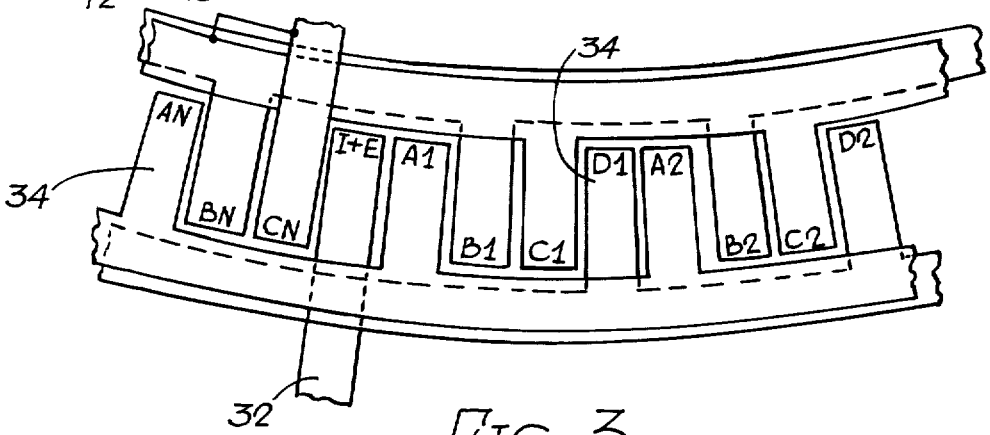
FIG. 3
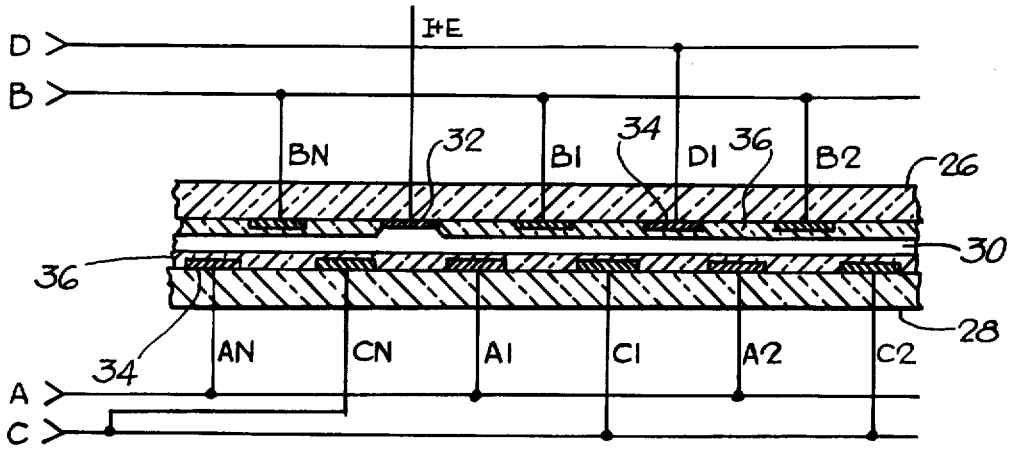
FIG. 4

POINTER MODE

FILL MODE

CIRCULAR PLASMA CHARGE DISPLAY DEVICE

BACKGROUND OF THE INVENTION

This invention generally relates to plasma charge transfer devices and, in particular, to devices of the type referred to as display tubes.

Devices of the general type referred to are described in Coleman, et al. U.S. Pat. No.3,781,600, dated Dec. 25, 1973, and entitled "Plasma Charge Transfer Device". Such devices generally comprise a channel containing an ionizable medium, particularly an ionizable gas such as neon and nitrogen. The channel is defined within a walled structure and for display purposes, at least one wall is formed of a transparent material. An input electrode is provided at one end of the device, and transfer electrodes are located opposite each other in a line extending along the channel. By applying potential differences between the oppositely positioned electrodes, the gas is ionized, and light emission occurs. By applying the potential differences in proper sequence, and particularly through the utilization of a plurality of channels, light displays of numbers, letters, or other patterns can be realized. The arrangement permits shifting of the displays along the length of the devices, and holding of the displays in position when so desired.

PRESENT INVENTION

The present invention provides a plasma charge transfer device for display purposes wherein the channel comprises an endless length, for example, a circular configuration. Input and transfer electrodes are located so that a bar display or segment display can be displayed and shifted in either a clockwise or counterclockwise direction including shifting through the input location whereby the display can be circulated through one or more revolutions. The invention is characterized by a relatively straightforward structure whereby the advantageous features of the invention can be realized with maximum efficiency.

It will, thus, be seen that the invention has for its objects the provision of a novel plasma charge display device which includes an endless length channel containing an ionizable medium with means for displaying and shifting light emitting areas to various locations along the channel. It is more specifically an object of the invention to provide a device of the type described wherein the light emitting areas can be moved in either direction along the length of the channel, can be moved back and forth through the input position, and can make one or more revolutions around the device where desired. It is also an object of the invention to provide a device of the type described which is of a design that permits efficient manufacture.

Other objects and advantages of the invention will be apparent from a consideration of the following description including a consideration of the drawings which are described as follows:

FIG. 1 comprises a schematic illustration of a plasma charge transfer device characterized by the features of this invention;

FIG. 2 is a schematic illustration of the electrode arrangement for one plate of the type utilized in the device;

FIG. 3 is a fragmentary plan view of the face of a panel which is characterized by the features of the invention;

FIG. 4 is a cross-sectional view of the fragmentary portion of the panel illustrated in FIG. 3;

SPECIFIC DESCRIPTION OF THE DRAWINGS

Figure 5:
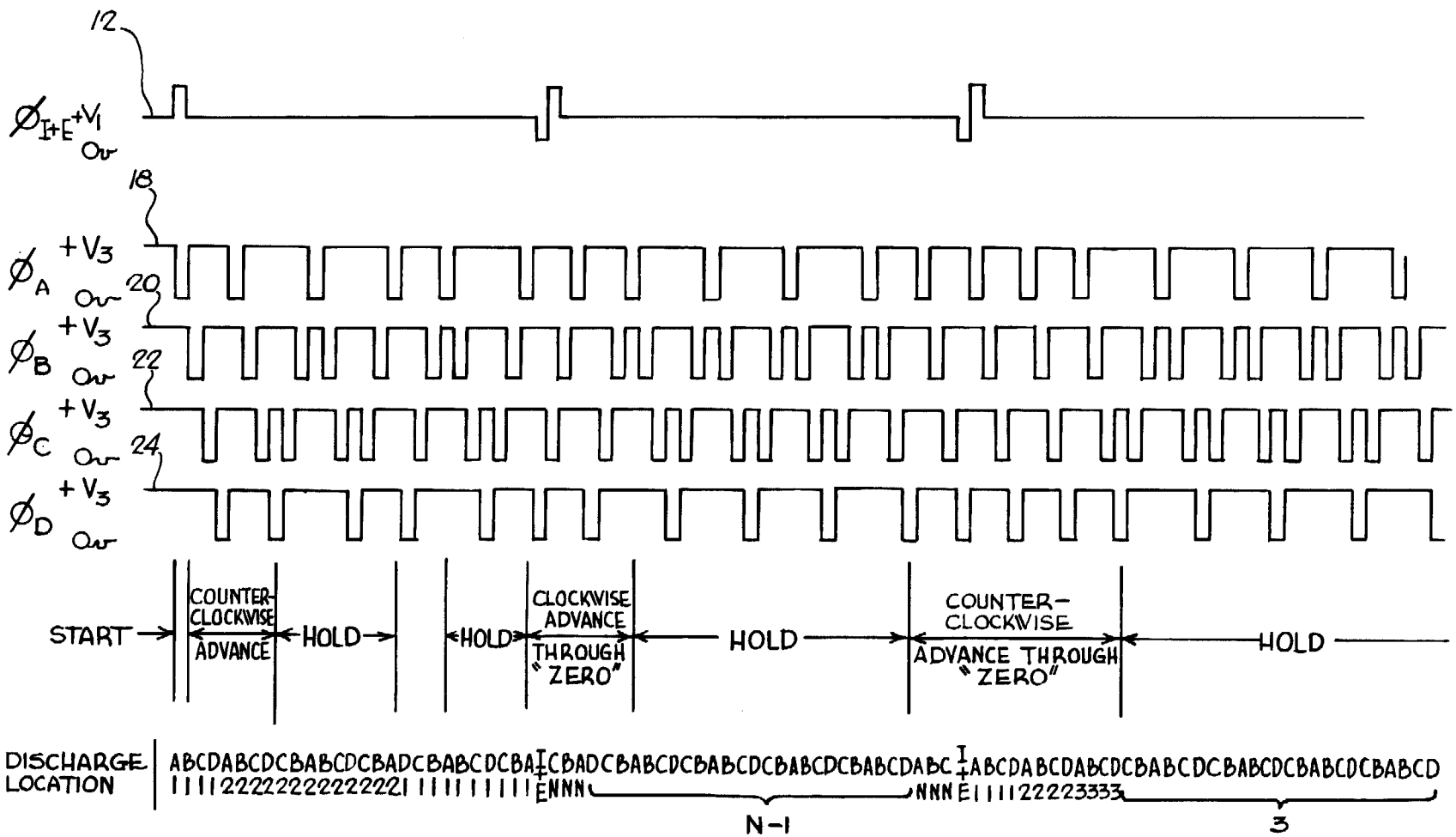
FIG. 5 is a chart illustrating wave forms which are developed during a typical operation of the device.

The device illustrated schematically in FIG. 1 includes a channel section 10 which is filled with an ionizable medium such as any one of or a mixture of the gases neon, argon, helium, krypton, xenon, hydrogen and nitrogen. In accordance with the characteristics of known plasma charge transfer devices, the illustrated structure includes a lead 12 for applying voltage to input electrode 14. A plurality of transfer electrodes 16 are disposed on either side of the input electrode. The transfer electrodes are divided into sets with the electrodes in each set being commonly connected to an external lead. In the arrangement illustrated, the sets are designated A, B, C and D. The external lead 18 is connected to each of the A electrodes, the lead 20 to each of the B electrodes, the lead 22 to each of the C electrodes, and the lead 24 to each of the D electrodes.

The electrodes are positioned in spaced relationship as illustrated in FIG. 1, and in addition, alternating electrodes are positioned on opposite sides of the channel 10. This is accomplished by forming a panel defining inside wall surfaces which thereby define the channel 10. The respective electrodes are secured in position on the respective inside walls.

FIG. 2 illustrates schematically the arrangement of electrodes on one wall, particularly the wall carrying the input electrode 14. The electrodes on opposite sides of the input electrode are each B transfer electrodes, and the next adjacent electrodes are D transfer electrodes with the B and D electrodes then alternating all along the length of the channel.

The wall carrying only A and C transfer electrodes is positioned in opposing relationship relative to the arrangement illustrated in FIG. 2 with the respective A and C electrodes being positioned between the B and D electrodes.

FIGS. 3 and 4 illustrate a structural arrangement characterized by the features of this invention. The structure comprises a rear plate 26 and a front plate 28. At least the front plate is formed of a transparent material, for example any suitable glass. The plates are held in spaced apart relationship, and a channel 30 is thus defined between the plates. The plates are sealed together at their inside and outside edges so that the ionizable medium is sealed within the structure.

A plurality of electrodes are disposed on the plate surfaces, these electrodes comprising an input electrode 32 and transfer electrodes 34. At least the electrodes 34 on the plate 28 are formed of transparent material, for example, tin oxide. A thin insulating coating 36 is disposed over each of the transfer electrodes, and at least the coating on the plate 28 will be transparent, for example a dielectric glass formed of a silkscreened glass paste.

Particularly as illustrated in FIG. 3, the resulting structure results in the presence of the ionizable medium between the opposed alternating transfer electrodes. Thus, the electrodes comprise interdigitated members, and it will be noted as shown in FIG. 3, that the electrodes are positioned in a regular alternating sequence. Thus, reading counterclockwise from the input electrode 32 shown in FIG. 3, the electrodes have a ABCD, ABCD, etcetera positioning. Reading clockwise, the electrodes are in the reverse sequence, that is, CBA, DCBA, DCBA, etcetera.

For the reasons more particularly set forth in the aforementioned U.S. Pat. No. 3,781,600, the input electrode 32 shown in FIG. 4 is exposed to the ionizable medium, that is, it is not covered by the insulating material 36. This enables start-up of the device when a sufficient potential difference is developed between the input electrode 32 and one of the oppositely positioned transfer electrodes 34 designated Al and CN in FIG. 4. The potential difference results in the creation of a positive charge adjacent the particular transfer electrode as is characteristic of devices of this type. By creating a sufficient potential difference between the next adjacent electrode and the electrode having the positive charge, the ionization position will shift accordingly. It will be noted that the direction of movement of the charge away from the input electrode 32 can be controlled depending upon the direction in which the required potential difference is applied. Accordingly, the development and shifting of charges can be carried out in either a clockwise or counterclockwise fashion.

FIG. 5 illustrates a typical sequence of operations involving a device of the type described. The upper line represents pulses applied to input electrode 32, and the remaining four lines illustrate, respectively, the input pulses applied to the transfer electrodes A, B, C and D. As has been noted, the transfer electrodes are all connected in common so that the application of potential through lead 18 will result in a pulse at each A transfer electrode and, similarly, the application of potential changes through leads 20, 22 and 24 will result in pulsing at each transfer electrode B, C and D, respectively.

As is indicated by the pulse chart of FIG. 5, the input lead 12 is normally at positive potential and is pulsed to a higher potential. Simultaneously, the A lead 18 which is normally at a positive voltage is pulsed to ground thereby creating a sufficient potential difference to ionize the gas between the input electrode 32 and transfer electrode Al. As is characteristic of plasma charge transfer devices, this results in a "pip" of light, and leaves a positive charge on the inside wall adjacent electrode A1. The B electrodes are then pulsed to ground, resulting in transfer of the charge to the opposite wall adjacent electrode B1. As indicated in FIG. 5, the C and D electrodes are then pulsed followed by additional successive ABCD pulses. This shifts the charge to a D2 electrode and, as shown in FIG. 3, a "hold" operation then occurs.

As indicated, the hold operation is achieved by pulsing in the sequence CBA, BCD, CBA. It will be appreciated that only an extremely short "hold" is illustrated, but that in practice a longer hold may be desired. Since "pips" will result in the case of each hold pulse, the result will be the appearance of a segment of light having a length corresponding to the distance between the D2 and A2 electrodes.

The hold operation illustrated in FIG. 5 results in the presence of a charge opposite the A2 transfer electrode, and a DCBA pulsing then results in movement of the charge to the position opposite the A1 electrode. A hold operation comprising a BCDCBA pulsing results in maintaining of the charge opposite the A1 electrode.

The next phase of the operation illustrated involves movement of the charge through the input electrode position. In this connection, it will be appreciated that the input electrode 32 of FIGS. 3 and 4 occupies the position of a D electrode. To result in the positioning of the positive charge opposite the electrode 32, this electrode is pulsed to ground, and the charge is then transferred opposite the CN electrode by pulsing the input electrode to sufficient positive potential compared with the ground potential to which the CN electrode is pulsed. Thereafter, the charge is moved in clockwise fashion to a position opposite the AN electrode by the application of B and A pulses. The charge is then moved further clockwise by the application of successive DCBA pulses. In order to hold the charge as indicated in FIG. 5, cycles of BCD and CBA pulses are applied. This results at the end of the hold operation in the location of the charge opposite the DN-1 electrode.

As indicated in FIG. 5, the application of ABC pulses and input pulses followed by an A pulse shifts the charge in a counterclockwise direction through the input position. Continued counterclockwise movement is achieved by moving the charge to the succeeding transfer electrodes including, in this instance, to the third set of commonly coupled electrodes. At this point, the charge can be held at the third set of electrodes by successive CBA, BCD pulses to thereby achieve a segment display in this area of the device.

The description provided illustrates the manner in which a charge can be moved back and forth through the input position. It will be appreciated that by continuing to shift the charge in either direction, the charge will eventually complete a full revolution and one or more successive revolutions could then be accomplished.

It will be noted that the electrode 32 is designated "I + E" which is for purposes of indicating that this electrode also serves an "erase" function. Specifically, whenever it is desired that a charge or charges be removed from the device, the charge is moved adjacent the electrode 32, and the electrode is pulsed to ground without a succeeding pulse being provided to shift the charge away from the electrode 32. In that event, the charge is conducted away through lead 12.

Figure 6:
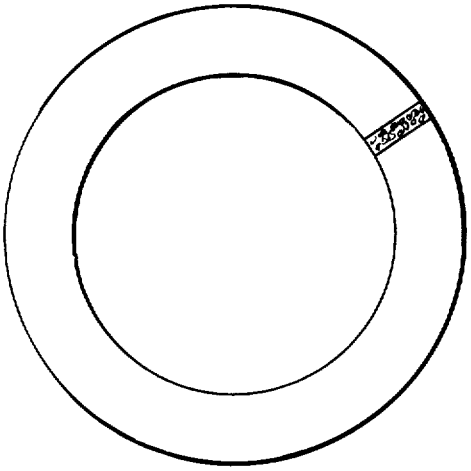
FIG. 6 is a schematic illustration of the display realized with the device in the course of a "pointer" mode of operation.
Figure 7:
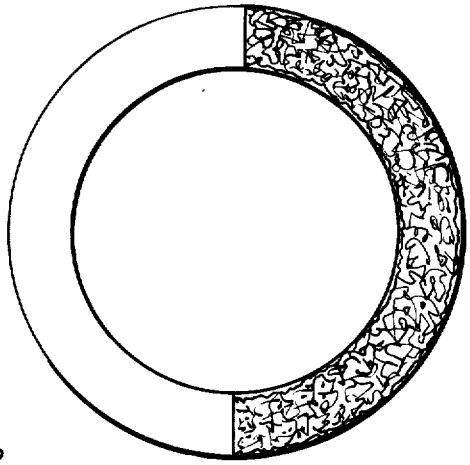
FIG. 7 is a schematic illustration of the display realized with the device in the course of a "fill" mode of operation.

The operation of the device illustrated in FIG. 5 results in a "pointer" mode of operation as shown in FIG. 6. Thus, in the hold or display condition, the light emitting area is a limited area, usually a length corresponding to the distance between A and D electrodes of the same set. The device can, however, be readily operated in accordance with a "fill" mode as illustrated in FIG. 7. In that instance, the operation involves the regular introduction of input pulses to add additional charges. In the case of a counterclockwise advancing operation, the input pulses are applied each time a ground pulse is applied to the A lead 18. Particularly during a hold or display operation, this will result in the appearance of a bar extending from the input position for the entire distance to the location of the first charge introduced. This apparent filling of the device with light is, of course, due to the fact that the pulses are applied so rapidly that the viewer appears to see all of the "pips" simultaneously. A similar appearance, of course, occurs in the case of the hold operation during the "pointer" mode.

Figure 8:
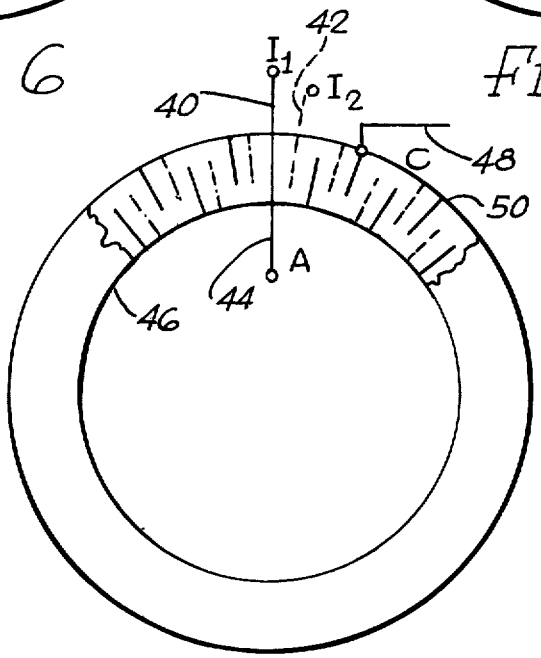
FIG. 8 is a schematic illustration of a device characterized by an alternative form of input electrode structure; and, FIG. 9 is a circuit diagram applicable to the form of the device illustrated in FIG. 8.
Figure 9:
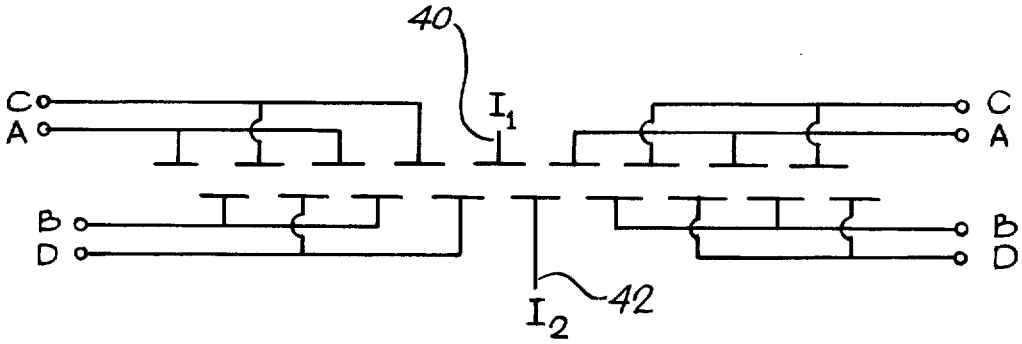

FIGS. 8 and 9 illustrate one alternative form of a device characterized by the features of this invention. In this construction, opposed side walls define a circular channel in the manner previously described. A first input electrode 40 is associated with one inside wall, and a second input electrode 42 is associated with the opposed wall. A transfer electrodes are supplied through lead 44 which is connected to the common conductor 46. The C transfer electrodes are supplied through lead 48 which is connected to the common conductor 50. The B and D transfer electrodes are illustrated by dotted lines and are located on the opposite side wall with the input electrode 42. The input and transfer electrodes are arranged in alternating sequence and offset from one another on the opposite inside wall surfaces in the same manner as is the case with respect to the embodiment of the invention previously described.

In the operation of the device of FIGS. 8 and 9, a potential difference is applied between the input electrodes. This will result in ionization of the medium and the positioning of a charge proximate one of these electrodes. The particular electrode having the charge proximate thereto is, of course, determined by the nature of the potential difference applied.

Where counterclockwise movement away from the input electrode position is desired, a charge is caused to form proximate the input electrode 40 and thereafter a pulse is applied to the D transfer electrodes to shift the charge away from the input electrode 40. Sequential DCBA pulsing shifts the charge around the device.

For clockwise movement, the charge is initially applied proximate input electrode 42 and pulses are then applied in the ABCD sequence. The charge is moved any distance desired as long as this sequence is repeated. The hold of a charge occurs in the same fashion as described in FIG. 5. Similarly, the input electrodes, when pulsed in proper sequence, are available for shifting the charge back and forth through the input electrode position. Finally, the input electrodes are available for erasure of a charge.

To accomplish this, a charge present on the D electrode is shifted to input electrode 40 and a discharge is then caused between the input electrodes 40 and 42 by applying voltage. This voltage is removed before the discharge is complete leaving the charged state of the input electrodes neutral. Thus, after the discharge between the D electrode and input electrode 40, the latter is left with a positive charge and when the discharge between electrodes 40 and 42 is started, electrode 40 starts to go negative, but by then removing the voltage at the "half-way" point, a neutral charge position results.

It will be understood that various changes and modifications may be made in the above described devices which provide the characteristics of the invention without departing from the spirit thereof, particularly as defined in the following claims.

That which is claimed is:

1. In a plasma charge transfer device of the type having a channel containing an ionizable medium, said channel being defined within a walled structure, at least one wall thereof being transparent, input and transfer electrodes positioned on inside wall surfaces, said transfer electrodes being arranged in alternating sequence and offset from one another on opposite inside wall surfaces, and means for applying a potential difference between adjacent electrodes whereby the medium will emit light proximate said adjacent electrodes and leave a charge proximate one of the adjacent electrodes, the improvement wherein: said channel comprises an endless length, a single input electrode is utilized located at a first position along the length of said channel, said transfer electrodes extending along the entire length of said channel whereby sequential application of potential differences enables shifting of light emission and charge positions in either direction relative to said first position.

2. A device in accordance with claim 1 comprising means for erasing a charge which is proximate a transfer electrode adjacent said input electrode, said erasing means including means for applying a potential difference between the input electrode and the adjacent transfer electrode which operates to conduct the charge through the input electrode and away from the device.

3. A device in accordance with claim 1 wherein said channel defines a circular configuration.

4. A device in accordance with claim 3 wherein a plurality of said channels are concentrically arranged.

5. A device in accordance with claim 1 wherein alternating transfer electrodes on the respective inside wall surfaces comprise a set of electrodes with each set being commonly connected to separate means for applying potential, said means for applying potential to said transfer electrodes being operable in a sequence corresponding with said arrangement of the transfer electrodes.

6. A device in accordance with claim 5 wherein a single input electrode is utilized, said input electrode being positioned on one inside wall surface immediately between a pair of commonly connected transfer electrodes on said one inside wall surface and immediately between a pair of separately connected transfer electrodes located on the opposite inside wall surface, and means for applying a potential difference between said input electrode and either one of said pair of transfer electrodes on said opposite inside wall surface to thereby permit shifting of light emissions and charge positions through said input electrode from one side to the other thereof.

7. A device in accordance with claim 6 wherein a transparent insulating layer is applied over said transfer electrodes, said input electrode being exposed to said medium.

8. A device in accordance with claim 7 wherein said electrodes are formed of transparent material.

9. In a plasma charge transfer device of the type having a channel containing an ionizable medium, said channel being defined within a walled structure, at least one wall thereof being transparent, input and transfer electrodes positioned on inside wall surfaces, said transfer electrodes being arranged in alternating sequence and offset from one another on opposite inside wall surfaces, and means for applying a potential difference between adjacent electrodes whereby the medium will emit light proximate said adjacent electrodes and leave a charge proximate one of the adjacent electrodes, the improvement wherein: said channel comprises an endless length, said transfer electrodes extending along the entire length of said channel, a pair of input electrodes are provided at said first position, one on each side of the device and offset from one another, means for applying a potential difference between the input electrodes, whereby a charge is developed proximate one input electrode for shift away from said first position in one direction, and a charge is developed proximate the other input electrode for shift away from said first position in the other direction.

10. A device in accordance with claim 9 wherein said inside wall surfaces are each defined by a wall of transparent material, each wall having an input electrode and a plurality of transfer electrodes.

11. A device in accordance with claim 10 including an external connection extending from said walls for each set of transfer electrodes, and a single external connection for an input electrode extending from one of said walls, the external connection for the input electrode on said opposite wall being connected to the common connection for one set of the transfer electrodes associated with said opposite wall whereby the input electrode on said opposite wall acts as a transfer electrode.

* * * * *